United States Patent [19]

Crawford

[11] 4,271,861

[45] Jun. 9, 1981

[54] DISHWASHER FILL LEVEL CONTROL ARRANGEMENT

[75] Inventor: John G. Crawford, Louisville, Ky.

[73] Assignee: General Electric Company, Louisville, Ky.

[21] Appl. No.: 83,911

[22] Filed: Oct. 11, 1979

[51] Int. Cl.[3] ..... F16K 31/18

[52] U.S. Cl. ..... 137/387; 137/412; 137/429; 68/207; 68/208; 134/57 D; 200/34; 200/84 R

[58] Field of Search ..... 134/57 D, 57 R; 137/386, 387, 412, 429; 68/207, 208; 200/34, 61.2, 84 R

[56] References Cited

U.S. PATENT DOCUMENTS

| | | | |
|---|---|---|---|
| 2,575,246 | 11/1951 | Carlstedt | 137/387 |
| 3,144,759 | 8/1964 | Bochan | 68/208 |
| 3,610,271 | 10/1971 | Jarvis | 134/57 D |
| 3,829,636 | 8/1974 | Scott | 134/57 D |
| 3,885,580 | 5/1975 | Cushing | 134/57 D |
| 3,894,555 | 7/1975 | Payne | 134/57 D |
| 4,004,600 | 1/1977 | Corn et al. | 134/57 D |
| 4,068,114 | 1/1978 | Johnson et al. | 134/57 D |
| 4,097,307 | 6/1978 | Geiger | 134/57 D |
| 4,180,085 | 12/1979 | Berges et al. | 134/57 D |
| 4,180,095 | 12/1979 | Woolley et al. | 134/57 D |

FOREIGN PATENT DOCUMENTS

| | | | |
|---|---|---|---|
| 925262 | 5/1963 | United Kingdom | 134/57 D |

*Primary Examiner*—Martin P. Schwadron
*Assistant Examiner*—G. L. Walton
*Attorney, Agent, or Firm*—H. Neil Houser; Radford M. Reams

[57] ABSTRACT

A dishwasher employing a float assembly positioned in a centrally located sump in close proximity laterally and vertically to a horizontally rotating circulation pump impeller inlet area for accurately terminating fill when the liquid level rises slightly above the dynamic prime level thereby enabling lower water usage by eliminating the need to overfill to compensate for inaccuracies in liquid level control. A baffle partially encloses the float to prevent nuisance trips resulting from liquid turbulence in the sump caused by pump operation. A cover is provided over the float mechanism to prevent nuisance trips caused by overspray striking the float. In its preferred form the float assembly comprises a multi-chambered open bottom float portion and an inverted U-shaped stem portion. One end of the U-shaped stem is connected to the float. The free end is slidably supported in a vertical standpipe formed in the bottom of the sump. The free end projects externally from the sump through the standpipe to operatively engage a switch mounted beneath the sump. The switch is operative to enable and terminate liquid fill.

7 Claims, 7 Drawing Figures

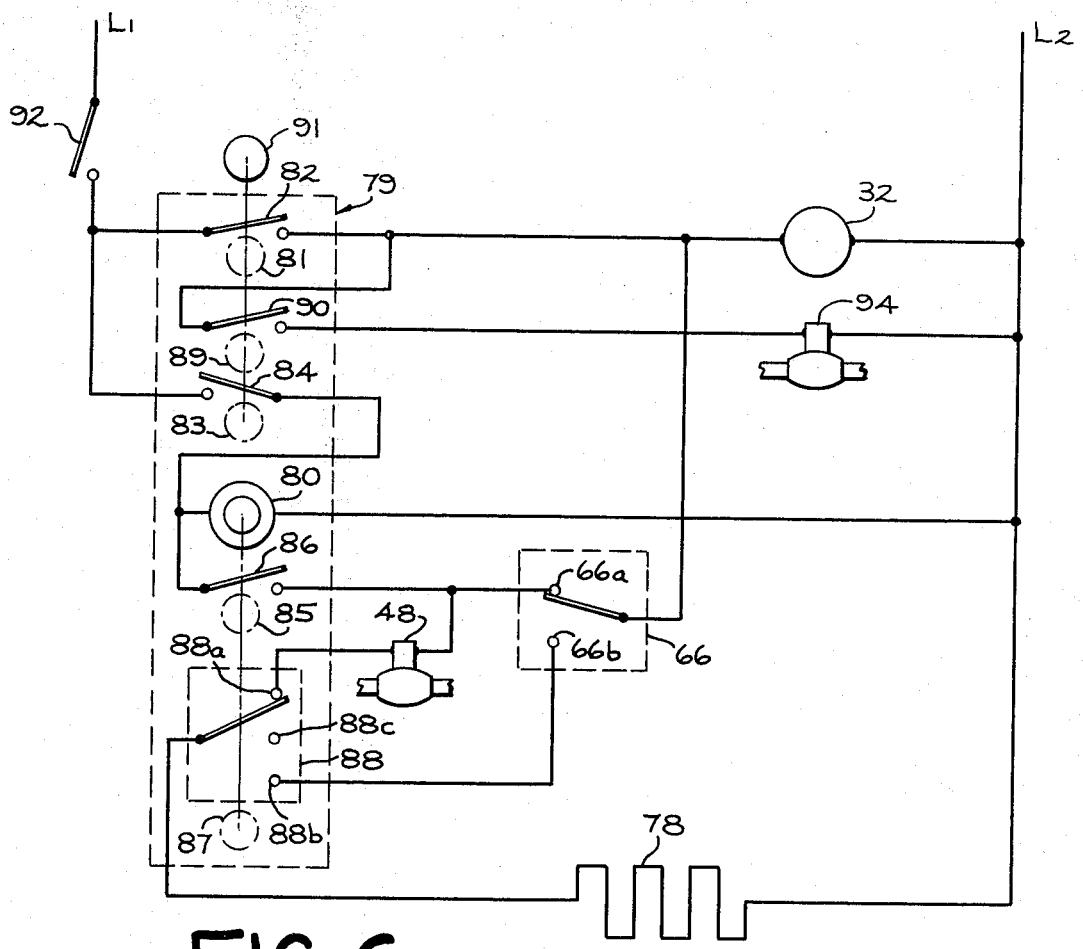
FIG. 6
FIG. 7
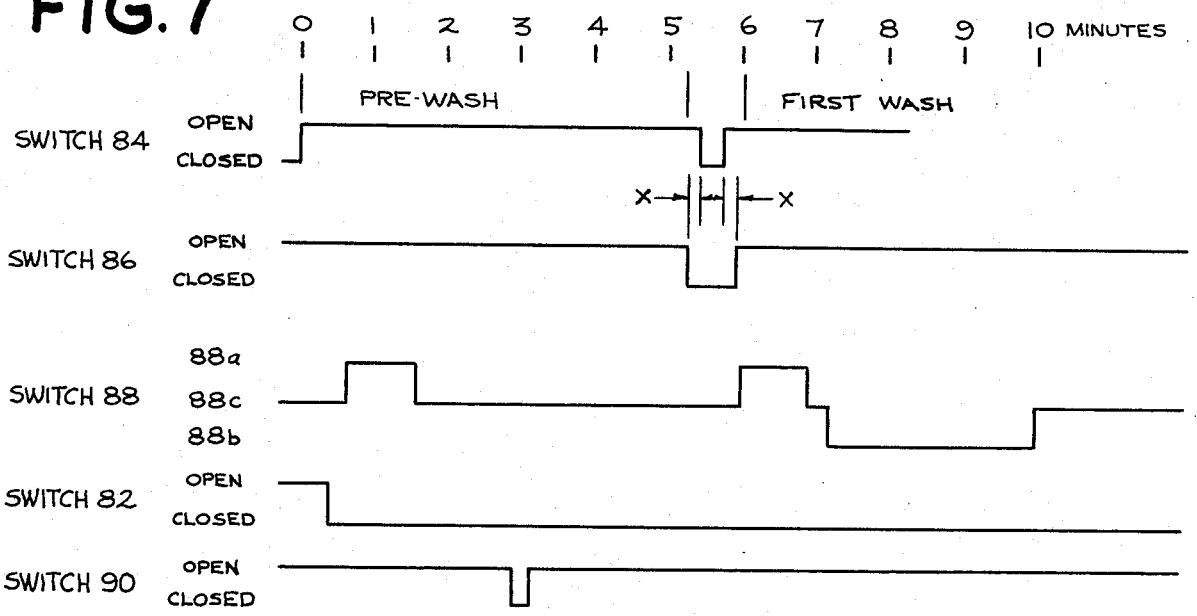

DISHWASHER FILL LEVEL CONTROL ARRANGEMENT

BACKGROUND OF THE INVENTION

This invention relates to a dishwasher employing a float device for accurate liquid fill control.

Most automatic dishwashers presently commercially available use timer means and a flow-controlled inlet or constant flow type water valve to meter the desired amount of liquid into the wash chamber. It is well known that due to manufacturing variations, timer inaccuracies and deterioration of the flow controlled inlet valve over time, this approach results in inaccurate fills. To insure against an insufficient fill using this approach, the nominal fill setting is intentionally higher than necessary. This intentional overfill results in satisfactory washability performance but at a cost of greater water and energy usage than is necessary. One means of reducing water usage in a dishwasher is to provide an accurate fill control means which eliminates the need for intentionally overfilling.

The use of float devices in dishwashers is well known in the art primarily for flood control. In this role the float is typically placed in a corner of the wash chamber remote from the sump. This arrangement too provides an inherently inaccurate level control. Two major contributing factors are the placement of the device at a location relatively remote from the center of the machine which makes the liquid level sensing very sensitive to machine levelling, and the relatively large surface area of the pool requiring a relatively large change in liquid volume to make a relatively small change in liquid level. Since accuracy in a flood control device is not essential, this arrangement works satisfactorily for that purpose. However, for the precise control of liquid fill required to enable minimum water usage, such an arrangement is clearly not satisfactory.

It is desirable therefore to provide a dishwasher which provides a simple, reliable and inexpensive arrangement for accurately controlling the amount of liquid used in the machine with a view to minimizing water usage and associated energy consumption.

Thus, it is one object of the present invention to provide a dishwasher with an improved liquid fill level control arrangement.

It is another object of this invention to provide such a dishwasher in which the liquid level control arrangement accurately senses the level of liquid in the wash chamber.

It is yet another object of this invention to provide such a dishwasher in which the liquid fill level control arrangement is relatively insensitive to non-level mounting of the dishwasher.

It is yet another object of this invention to provide such a dishwasher in which the liquid fill level control arrangement is not vulnerable to nuisance tripping.

It is yet another object of this invention to provide such a dishwasher in which the liquid fill level control arrangement includes a float device for accurately sensing the liquid level in the wash chamber.

It is yet another object of the present invention to provide such a dishwasher in which the liquid level control arrangement includes a float device which is capable of accurately terminating fill when the quantity of liquid provided to the wash chamber only slightly exceeds the quantity necessary to maintain the pump in its primed operating condition.

SUMMARY OF THE INVENTION

The present invention provides a dishwashing appliance which employs a float assembly in the sump to accurately and reliably control the amount of liquid admitted to the wash chamber during wash and rinse cycles. This allows a significant reduction in the amount of liquid used in each wash or rinse cycle by eliminating the need to overfill to compensate for inaccuracies in liquid measurement. In addition, since less liquid is in the machine, less energy is expended to heat the liquid.

In accordance with one embodiment of this invention a dishwashing appliance is provided with a sump centrally located in the bottom of the dishwasher. A circulation pump for distributing liquid throughout the wash chamber of the appliance is centrally positioned within this sump. The pump includes an impeller arranged to rotate in a horizontal plane. The bottom edge of the impeller is vertically spaced apart from the bottom of the sump, with the bottom edge of the impeller defining a dynamic prime liquid level within the sump. The pump operates during, as well as after, fill providing a dynamic fill operation. Since the pump operates during fill, the liquid level in the sump rises rapidly until reaching the minimum dynamic prime level. The liquid level within the sump is held at this level by the impeller until the quantity of the liquid within the distribution system increases to a stable dynamic condition, which exits when the pump is primed. Once the pump is primed the liquid level again rises rapidly until fill is terminated. A float is positiond in the sump in close proximity to the main pump impeller inlet area to sense the liquid level in the sump and to terminate liquid fill when the liquid level rises to a predetermined level slightly above the prime level. Baffle means partially encloses the float to prevent nuisance trips caused by liquid turbulence in the sump near the pump, and a cover is provided for the float to prevent nuisance trips caused by overspray striking the float.

In a preferred form the float assembly employed to accurately sense the liquid level in the wash chamber comprises a multi-chambered open bottom float portion and an inverted U-shaped stem portion. A first leg of the stem portion projects upwardly from the float portion. The second leg of the stem portion is slidably supported in an opening in a vertical stand pipe formed in the sump bottom. The free end of the second leg projects externally from the bottom of the sump through the stand pipe to actuate a switch mounted beneath the sump adjacent the opening. This switch is operative, when actuated by the float, to enable energization of a solenoid fill valve to admit liquid to the wash chamber and, when de-actuated by the lifting of the float by the liquid in the wash chamber, this switch prevents energization of the fill valve solenoid to terminate fill.

Placement of the float assembly in the sump in close proximity laterally and vertically to the main pump impeller inlet area enables level sensing accuracies on the order of plus or minus 10%. The cover and baffle means enable the level control mechanism to function substantially free of nuisance trips notwithstanding this placement of the float.

BRIEF DESCRIPTION OF THE DRAWINGS

FIG. 6 is a schematic representation of the illustrative control circuit employed in the dishwasher embodiment of FIG. 1.

FIG. 7 is a timing chart schematically representing the action of the timer controlled, cam-actuated switches in the circuit of FIG. 6 for part of an operating cycle.

DETAILED DESCRIPTION OF THE INVENTION

Figure 1:
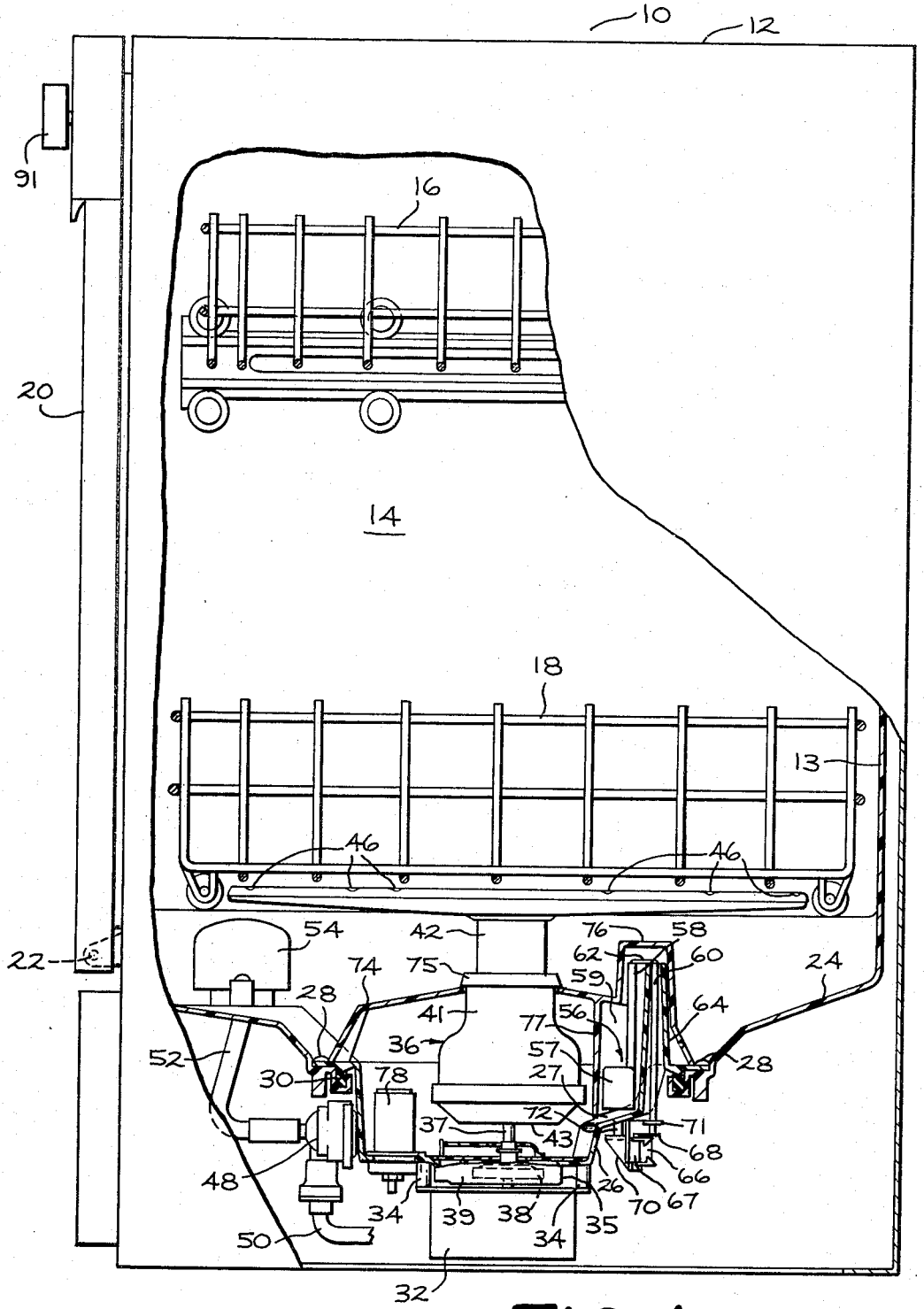
FIG. 1 is a side view of a dishwasher embodying one form of the present invention with portions cut away to show certain interior features.

FIG. 1 illustrates an exemplary embodiment of the dishwashing appliance incorporating one form of the present invention. The washing appliance of FIG. 1 comprises an automatic dishwasher 10 having an outer cabinet 12 and a tub 13 defining therein a wash chamber 14. Disposed within wash chamber 14 are dish-supporting racks 16 and 18 adapted to receive and support dishes or other articles to be washed witin wash chamber 14. A door 20 is pivotally mounted in one wall of cabinet 12 by hinge means 22 to provide access to wash chamber 14.

The lower extremity of wash chamber 14 is defined by a bottom wall 24 which slopes toward the center of the dishwasher. A sump 26 for accumulating washing liquid in the wash chamber is centrally disposed in the bottom wall 24 below the low point of bottom wall 24, defining the lowermost portion of wash chamber 14. Sump 26 is secured to bottom wall 24 by fasteners 28. An annular sealing gasket 30 is provided between bottom wall 24 and sump 26 to prevent leakage.

A pump motor 32 is centrally disposed beneath sump 26 and secured to sump 26 by screws (not shown) received in bosses 34 formed integrally with sump 26 for driving drain pump 35 and main circulating pump 36. A drive shaft 37 extends upwardly through sump 26 to drive the drain pump impeller 38 enclosed within drain pump housing 39 and the main pump impeller 40 (FIG. 2) enclosed within main pump housing 41. Main pump housing 41 is positioned vertically a predetermined distance above the bottom of sump 26 to allow liquid to initially accumulate in the sump beneath the pump. Main pump inpeller 40 (FIG. 2) is mounted to drive shaft 37 for rotation in a substantially horizontal plane. Extending upwardly from main pump housing 41 is a pedestal 42 which rotatably supports a reaction-type spray arm device 44. Washing liquid collected in sump 26 enters pump 36 through the impeller inlet area 43 and is then pumped by the impeller into spray arm 44 by the main pump. Spray arm 44 has a plurality of orifices 46 through which washing liquid is ejected to effectuate a spray action to distribute washing liquid against articles placed within racks 16 and 18. The term "fully primed" as used herein refers to that operating condition in which liquid in the tub excluding that in the sump, i.e. in the air, on the dishes, on the sidewalls, and in the distribution system, including the pump chamber, and spray arm while the pump is operating is maximum.

It should be noted that the term washing liquid or liquid is used herein to cover any liquid distributed by the pump and spray arm. During the wash cycle the liquid typically consists of hot water with detergent dissolved therein and also during the rinse cycle the liquid typically consists of clear water or it may include rinse additives.

The flow of liquid into wash chamber 14 from the ordinary pressurized household water supply is controlled by fill control means in the form of solenoid fill valve 48 which may be any of a number of well known solenoid valve devices readily commercially available. Conduit 50 connects the inlet port of valve 48 to the household water supply.

Flexible hose 52 passes from the outlet port of valve 48 into the interior of wash chamber 14 through a bilevel standpipe (not shown) formed integrally with bottom wall 24. One level of the bilevel standpipe provides a vacuum breaker in the inlet line and the other provides flood level control means. Cover 54 encloses the standpipe and prevents over spray from leaking out of the wash chamber through the standpipe. The liquid entering the wash chamber through hose 52 passes through slotted openings (not shown) in the sides of cover 54 near the bottom wall 24. A more detailed description of the structure and operation of this inlet apparatus is presented in the copending, commonly-assigned U.S. patent application, Ser. No. 046,982, by John G. Crawford et al, entitled "Dishwasher Inlet Air Gap" filed June 8, 1979, incorporated herein by reference.

Figure 2:
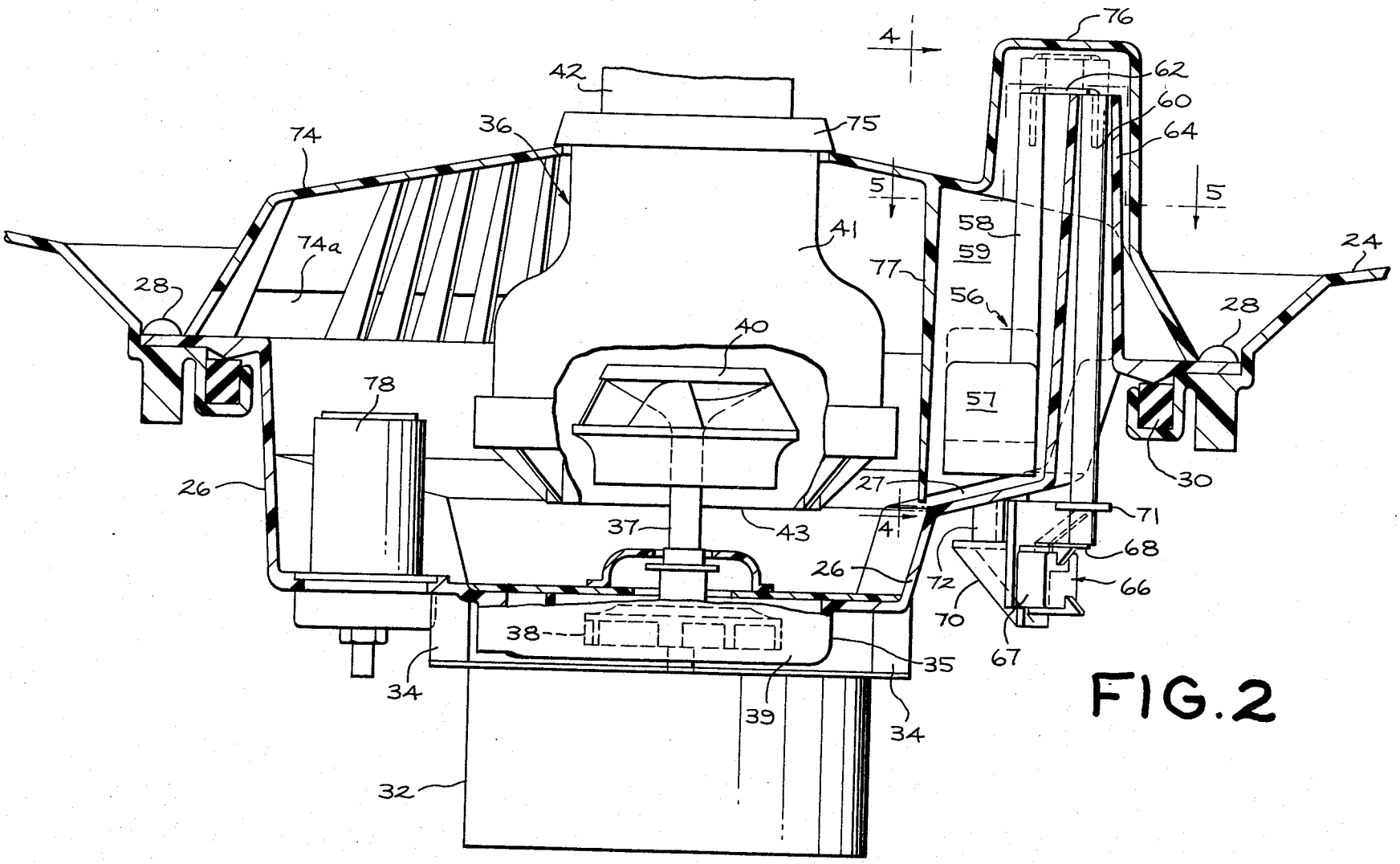
FIG. 2 is an enlarged side view of the sump area of the dishwasher embodiment of FIG. 1.
Figure 3:
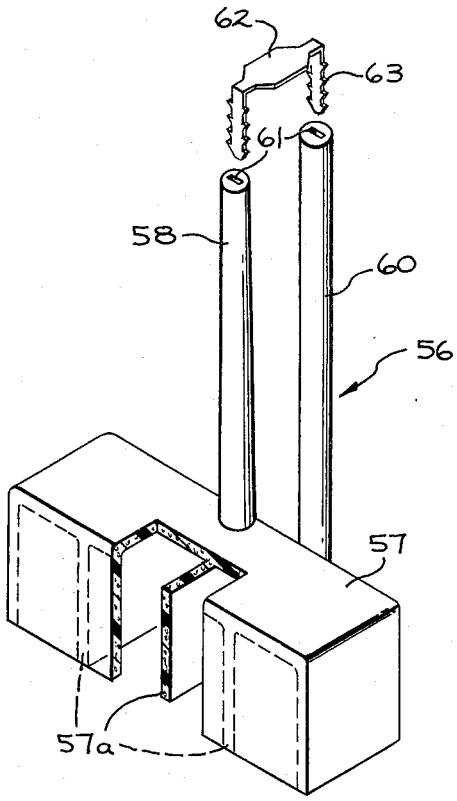
FIG. 3 is a perspective exploded view of the float assembly employed in the illustrative dishwasher embodiment of FIG. 1.

Precision positive liquid fill control is provided by float assembly 56 comprising a float portion 57 and stem portions 58 and 60 joined by U-shaped stem connector 62 as best seen in FIGS. 2 and 3. Float portion 57 is positioned within the sump 26, in close lateral proximity to main pump 41 and positioned vertically such that the bottom of float portion 57 is in close proximity to the lower edge of main pump impeller 40. The wall of sump 26 projects radially to form a pocket 59 over ledge 27 to receive float portion 57. The positioning of the float portion 57 is significant in achieving the desired accurate liquid level control. The lateral positioning of the float in close proximity to the centrally mounted pump places the float close to the center of the tub bottom. This helps minimize the effect of a non-level appliance set up on liquid level sensing accuracy. The vertical position of the float is arranged to terminate fill when the liquid level in the sump slightly exceeds the prime level; that is, that level at which the pump is fully primed.

The circulation pump operates throughout the fill period. Thus, as liquid enters the wash chamber from conduit 52, it collects in the sump 26 beneath main pump housing 41 until the liquid level rises to the bottom edge of impeller 40. This edge defines the dynamic prime liquid level referred to hereinafter simply as the prime level. As additional liquid continues to enter the sump from the household supply, impeller 40 begins drawing liquid into the main pump 36 for circulation into wash chamber 14. Thus, main pump impeller 39 is operative to prevent the liquid level in the sump from exceeding the prime level until the pump is primed. Once the pump is fully primed additional liquid flowing into the wash chamber from the household supply causes the liquid level to rise above the prime level. This rise lifts float assembly 56 thereby terminating fill in a manner to be described hereinafter. The liquid level rises significantly with relatively little increase in volume after the pump is primed because the steeply sloped contour of the sump together with the volume occupied by main pump 36 above the prime liquid level is such that the surface area of the pool of water collected in the sump is relatively small, resulting in a relatively large change in liquid level for a relatively small change in liquid volume. Fill is terminated by float assembly 56 when the liquid level rises to a predetermined full level selected to be slightly in excess of the prime liquid level. A predetermined finite difference is provided between the prime level and this full level at which the float terminates fill sufficient to prevent nuisance tripping of the fill control switch by the float due to turbulence of the liquid in the area of the float prior to the pump becoming fully primed. In the illustrative embodiment this difference, that is the difference in height between the prime level and the full position, is approximately one inch.

It has been found that the level control arrangement of the above described embodiment in the exemplary machine can control the liquid level to within plus or minus 10 percent of the nominal fill level. This is a total system accuracy figure which includes manufacturing and performance tolerance of the components as well as liquid turbulence effects. In the illustrative embodiment, liquid turbulence is believed to contribute roughly one third of the system error. For a nominal fill of 1.5 gallons, this provides an accuracy of roughly plus or minus one pint.

The orientation of the main pump impeller for rotation in a horizontal plane is believed advantageous in achieving accurate level control using the illustrated level sensing arrangement. Since the rotation is substantially parallel to the plane of the liquid surface in the sump, the impeller is operative to prevent the liquid level from exceeding the prime level with relatively little liquid turbulence in the sump as compared to an arrangement in which the plane of rotation is perpendicular to the liquid surface, an arrangement frequently employed in presently available dishwashers. This reduction in turbulence near the float makes for a more accurate float response.

An additional advantage of this liquid level arrangement is that just slightly more than enough liquid to prime the pump is always provided regardless of the quality or condition of the liquid. It has been observed that the exact quantity of liquid required to prime any particular dishwasher pump varies depending upon the nature or condition of the liquid. For reasons not fully understood, when the washing liquid comprises water with detergent or rinse aid or food soils dissolved in it, more liquid is required to prime the pump than when the liquid comprises plain water. With the level control arrangement of the present invention, a fill sufficient to prime the pump will always be provided since the fill is terminated in response to the rise of the liquid above the prime level. When operating in the dynamic fill mode, this can only occur when the pump is primed.

The structure of float assembly 56 in its preferred form is best seen in FIG. 3. Float portion 57 is a multi-chambered, box-like structure having an open bottom. The float portion is partitioned into chambers by wall portions 57*a*. The bottom of the float is open to prevent liquid from accumulating in the float. A fully sealed float could be used for most accurate float response. However, such a structure would be vulnerable to liquid accumulation in the float if a leak developed. This would gradually degrade performance. Thus, the open bottom structure is preferred. Since the float is open-bottomed, waves caused by liquid sloshing about in the sump area could change the buoyancy of the float by replacing a portion of the air which would ordinarily be trapped in the float when the float is being raised by the liquid. This could adversely affect the accuracy of the float for that particular cycle. By partitioning the float, the wall portions 57*a* act as breakwaters and greatly reduces the effect of such waves.

First stem portion 58 is formed integrally with float portion 57 and extends vertically upward therefrom. A second stem portion 60 is a rod-like element formed separately. A slot 61 is formed in the free end of stem portion 58 and in one end of stem portion 60. A U-shaped connector clip 62 is used to join the stem portions to form a U-shaped float stem. One leg of clip 62 is received in each of slots 61. Each leg of clip 62 includes barbs 63 projecting outwardly to help prevent the legs from slipping out of the slots. Connector 62 joins the separately formed stem portions 58 and 60 to provide proper parallel alignment thereof. However, the entire float assembly 56 could be integrally formed.

Referring again to FIG. 2, a standpipe 64 is formed as a circular protrusion integral with and extending upwardly from the bottom of sump 26. Standpipe 64 slidably receives stem portion 60. The interior of standpipe 64 defines an opening extending through the bottom of sump 26. A standard single pole, double throw snap action switch 66 includes a housing 67 and a leaf actuator 68. The switch is mounted to the outside of sump 26 by bracket 70 with leaf actuator 68 adjacent the opening through the bottom of sump 26 provided by standpipe 64. Bracket 70 is secured to sump 26 by a screw (not shown) received in integrally molded boss 72. Bracket 70 also includes a guide portion 71 having an aperture positioned directly beneath the bottom stand pipe opening. Stem portion 60 projects externally from sump 26 through the interior of stand pipe 64 and the aperture in guide portion 71. Leaf actuator 68 extends beneath the aperture in guide portion 71 for engagement by stem portion 60.

When the liquid level in the sump is less than a predetermined minimum level, float assembly 56 is in its lower or rest position. This position is shown in full lines in FIG. 2. In the rest position, the weight of the float system causes stem portion 60 to depress upwardly biased actuator leaf 68 sufficiently to actuate switch 66 thereby placing switch 66 in a reset position. Switch 66 is electrically serially connected with fill valve solenoid 48 so that, when in its reset position switch 66 enables energization of the fill solenoid valve 48. As the liquid level increases during a fill operation, float portion 57 is engaged and raised by the rising liquid. Switch 66 is mounted relative to stem 60 such that when the liquid level rises to a predetermined level slightly above the prime level, designated a full level, float assembly 56 is in its full position, and stem 60 releases leaf actuator 68 sufficiently to deactuate switch 66 thereby placing switch 66 in its full position. This position is illustrated by phantom lines in FIG. 2. When in its full position, switch 66 prevents the energization of fill valve 48. Thus, switch 66 is effective to terminate fill when the liquid level in the wash chamber reaches the full level. As previously described herein, the liquid level initially rises rapidly to the prime level and remains at that level until the pump is primed. The predetermined full level is selected to be just enough higher than the prime level to avoid nuisance tripping when the liquid level is at the prime level.

In the illustrative embodiment the difference in height between the prime level and the predetermined full level is selected to be approximately one inch. This difference results from a nominal distance of ½ inch between the bottom of impeller 40 and the bottom of float 56 in its rest position and a travel distance for the float of 0.4 inch between its rest position and its full position.

During drain cycles as the liquid is removed from the sump area, float means 56 moves downward toward its rest position causing stem portion 60 to gradually depress leaf actuator 68. The regulation characteristic of switch 66 is chosen such that greater depression of the leaf actuator 68 is required to place the switch 66 in its reset position than to retain switch 66 in its reset position. Thus, switch 66 remains in its full position as the sensed liquid level recedes from the full level until the sensed liquid level recedes to a second predetermined level, designated the reset level, which is lower than the full level. Upon reaching this level, leaf actuator 68 is sufficiently depressed by stem portion 60 to place switch 66 in its reset position. Thus, float assembly 56 is operative to move switch 66 to its full position when the sensed liquid level rises to the predetermined full level and to move switch 66 to its reset position when the sensed liquid level recedes to the predetermined reset level. This regulation characteristic aids in preventing the switch from nuisance trips due to slight fluctuations in sensed liquid level as typically occur during wash and rinse cycles in which liquid is being circulated in the wash chamber by the main pump. In the illustrative embodiment, the full liquid level is predetermined to be approximately 1.5 gallons of liquid in the wash chamber and the reset level is predetermined nominally to be 1.25 gallons.

A molded plastic sump cover 74 having a central opening for receiving pedestal 42 is mounted over main pump housing 40 and held in place by a threaded collar 75 which is threaded onto pedestal 42. Cover 74 includes a raised cylindrical portion 76 positioned to cover standpipe 64. This cover prevents the overspray in the wash chamber from stiking the float assembly thereby helping avoid nuisance tripping of switch 66 and also preventing liquid from leaking out of the wash chamber through standpipe 64. Openings 74*a* are provided around the periphery of cover 74 to allow the water draining down the sidewalls of the wash chamber and drain off of the cover itself to enter sump 26.

Figure 4:
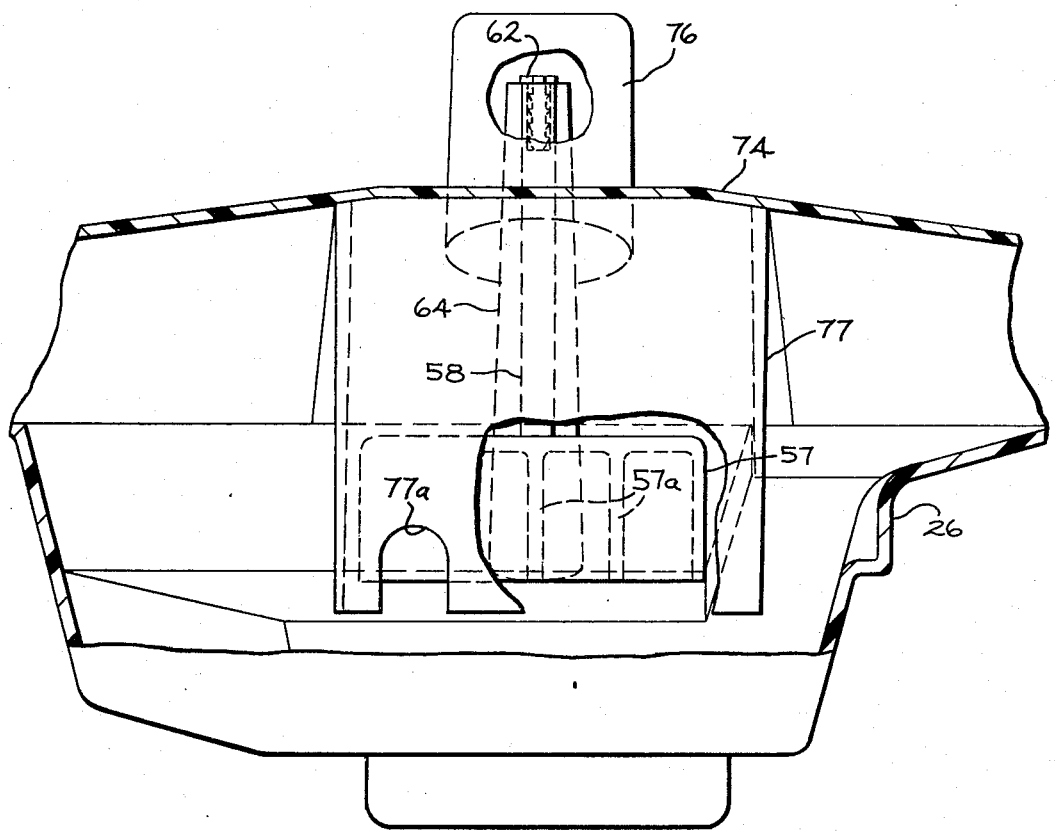
FIG. 4 is a cross-section view of the sump area of FIG. 2 taken along lines 4—4.
Figure 5:
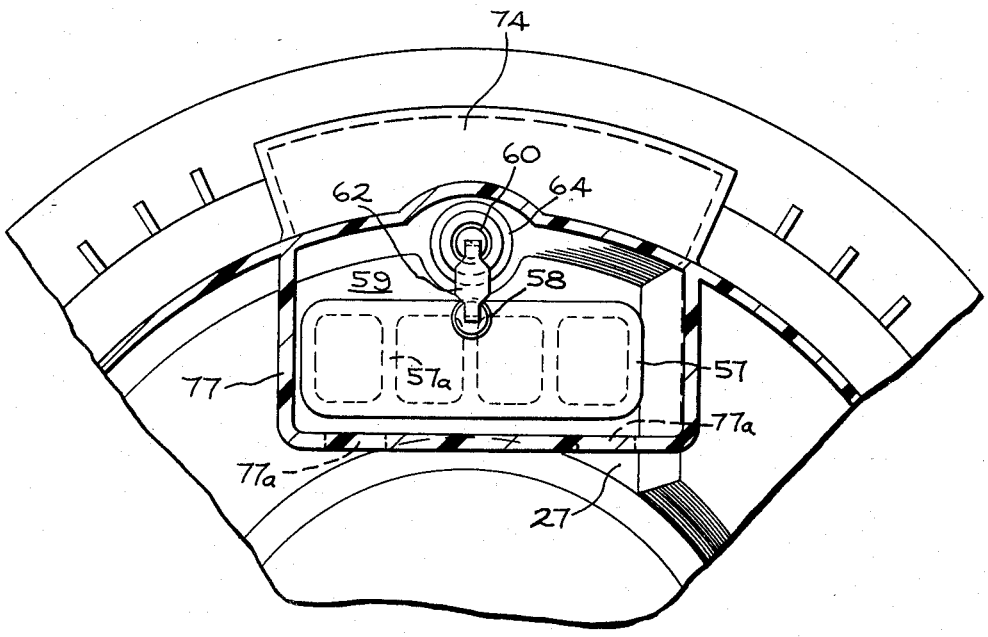
FIG. 5 is a cross-sectional view of the sump area of FIG. 2 taken along lines 5—5.

As additional protection against nuisance trips caused by liquid level turbulence in the vicinity of the float, baffle means is employed to provide a sheltered region around float portion 57 which enables the liquid level in the vicinity of the float to remain relatively calm. In its preferred form, as best seen in FIGS. 4 and 5, the baffle means comprises a wall portion 77 formed integrally with and projecting downward from cover 74 to substantially enclose the float on three sides. A gap is provided between sump ledge 27 and the bottommost edge of wall portion 77 to allow liquid to pass beneath the wall portion. In addition, apertures 77*a* (FIG. 4) are provided in the wall portion to allow additional clearance for liquid flow in and out of the float area. Although, in the preferred form of the sump cover the wall portion is integrally formed with the cover, an alternative form for the baffle means could be a wall formed integrally with the sump and extending upwardly around the float area, with sufficient slots in the bottom of the wall to allow liquid to pass in and out of the area of the float. As seen in FIG. 5 and also in FIG. 2, the remaining side of the float area not protected by the wall is protected by sump cover 74.

Heater means for heating the liquid in the wash chamber is provided in the illustrative embodiment in the form of a high watt density (nominally 1000 watt) resistive heater 78 (FIG. 2) which is enclosed in a cylindrical protective cover mounted to the bottom of sump 26. Because of the relatively high power output of the heater 78, it is undesirable to energize the heater with insufficient liquid in the sump area. As described in greater detail with reference to the control circuit of FIG. 6, float switch 66 enables effective energization of heater 78 when in its full position and prevents effective energization of heater 78 when in its reset position.

Thus, during normal operation, the float arrangement terminates fill and enables effective heater energization when the liquid level rises to the full level slightly above the prime level. However, the float may become stuck in its up position corresponding to the full liquid level, as a result of food particles or other foreign objects jamming the float mechanism. In that event, the float would be prevented from activating switch 66 when the liquid level recedes such as during a drain cycle. Thus, float switch 66, because of the malfunction of the float, would simultaneously prevent the entry of liquid into the wash chamber and enable energization of the heater. Consequently, means are provided in the control circuit to detect such a malfunction and prevent energization of the heater in such circumstances. This feature of the control system is more fully described in commonly assigned, co-pending U.S. patent application Ser. No. 083,912 by Donald S. Cushing, filed the same date as the present application and entitled "Heater Protection Arrangement for a Dishwasher," incorporated herein by reference.

Referring now to FIG. 6, an exemplary control circuit for controlling the dishwashing appliance of this invention is shown in schematic form. Power for the control circuit is provided on power lines L1 and L2 which are adapted for connection to a conventional 110 volt 60 Hz AC power supply such as an ordinary household electrical plug-in receptacle. A door switch 92 is serially connected in line L1. Door switch 92 is adapted to be closed as the door latching means (not shown) for door 20 is operated to secure door 20 in its closed position, and to be open when door 20 is not latched closed. Thus, switch 92 serves to de-energize the control circuit whenever door 20 is not secured in its closed position to prevent the escape of washing liquid from wash chamber 14.

The cyclical operation of the various circuit components is controlled by sequence control means 79 comprising a timer motor 80, a plurality of cams 81, 83, 85, 87 and 89 and respective associated cam-actuated switches 82, 84, 86, 88 and 90 and a manually operable user control knob 91. The cams 81, 83, 85, 87 and 89 and control knob are mounted to a cam shaft driven by the drive shaft of timer motor 80. Each of the cam-actuated switches is mounted adjacent its associated cam in a manner well known in the appliance control art for sequential actuation of the various switches. Cam-actuated switch 82 connects pump motor 32 across lines L1 and L2. Cam-actuated switch 84 is connected in series with timer motor 80 across lines L1 and L2, thereby controlling energization of timer motor 80 independently of the liquid level in the wash chamber. Cam-actuated switch 86 is connected in series with double throw float switch 66 and timer motor 80 to provide a parallel path for controlling energization of timer 80 which shunts switch 84 when float switch 66 is closed to terminal 66*a* and switch 86 is actuated. Cam-actuated switch 88 is a three position switch which controls energization of the fill valve solenoid 48 and the heater 78; when closed to terminal 88*a*, switch 88 enables energization of the fill solenoid 48 and prevents effective energization of heater 78; when closed to terminal 88*b*, switch 88 enables effective energization of heater 78 and prevents energization of fill solenoid 48; and when closed to terminal 88*c*, switch 88 prevents energization of fill solenoid 48 and heater 78. Cam-actuated switch 90 is connected in series with drain solenoid 94 across lines L1 and L2.

As previously described herein, the liquid level control arrangement in the illustrative embodiment includes a single pole double throw snap action switch 66 actuated by mechanical float assembly 56 (FIG. 1). As shown in FIG. 6, switch 66 has first and second operative positions. Closure to terminal 66*b* defines the first position also designated the full position and closure to terminal 66*a* defines the second or reset position switch 66 is normally biased toward terminal 66*b*. As previously described, float means 56 is operative to move switch 66 to its full position, closed to terminal 66*b* when the liquid level in the wash chamber sensed by float 56 equals or exceeds a predetermined full level. At this level, the liquid sufficiently raises float means 56 to cause stem portion 60 to release leaf actuator 68 enough to move switch 66 to its full position. When the liquid level sensed by float means 56 is less than the reset level, float means 56 is operative to move switch 66 to its reset state, closed to terminal 66*a* by causing stem portion 60 to sufficiently depress leaf actuator 68.

Thus, fill is positively controlled by electrically connecting solenoid fill valve 48 to terminal 66*a* of float switch 66. Energization of fill valve solenoid 48 is enabled when float switch 66 is in its reset position closed to terminal 66*a* and prevented when switch 66 is in its full position closed to terminal 66*b*. Fill valve solenoid 48 is connected via terminal 88*a* to heater 78. Solenoid 48 is a high impedance device relative to heater 78 and thus when solenoid 48 is serially connected with heater 78 across power supply the power dissipated by heater 78 is minimal and not effective to significantly heat the liquid in the wash chamber. Thus, the high impedance of solenoid 48 prevents effective energization of heater 78 when operating in the fill mode. Switch 88 is switched by timer motor 80 to terminal 88*a* at the beginning of a fill cycle and is switched to terminal 88*c* after a predetermined period of time designated fill time has elasped, thereby providing redundant fill control. The predetermined fill time is sufficient to allow the liquid level to reach a predetermined level above full to allow the float to control fill under normal operation. The timed fill provides a backup level control to protect against flooding in the event of a malfunction of the float means.

Heating of the washing liquid during various operating cycles is controlled by cam-actuated switches 82 and 88 together with float switch 66. Terminal 66*b* of float switch 66 is connected to heater 78 through terminal 88*b* of switch 88. When float switch 66 is in its full position closed to terminal 66*b* and switch 88 is closed across terminal 88*b*, effective energization of heater 78 is enabled since heater 78 will be directly connected across lines L1 and L2 when switch 82 is closed. When float switch 66 is in its reset position, effective energization of heater 78 is prevented, since only a minimal amount of power is dissipated in the heater 78 when connected in series with fill valve solenoid 94. Thus, even though heater 78 is partially energized in series with fill valve solenoid 48 during fill periods, effective energization of heater 78 is prevented when the liquid level sensed by float means 56 is less than at least the reset level.

A brief description of the operation of the illustrative embodiment of the dishwasher of the present invention will now be given with reference to the circuit of FIG. 6 and the timing diagram of FIG. 7. First door 20 is secured in its closed position to close switch 92. Then user control knob 91 is manipulated by the user typically by rotation thereof a few degrees to initiate operation of the dishwasher 10 by causing switch 84 to close. Closure of switch 84 connects timer motor 80 across power lines L1 and L2. As shown in FIG. 7, shortly thereafter, timer motor 80 closes switch 82 energizing pump motor 32. After a brief period switch 88 is closed by timer motor 80 to terminal 88*a*, to initiate a pre-wash cycle with a first fill period. It should be noted that pump motor 32 is energized throughout the various cycles thereby providing a dynamic fill each fill cycle. It is assumed in the present example that initially only a nominal amount of liquid, if any, is present in the wash chamber 14, and that float means 36 is operating normally, causing switch 66 to be in its reset position, closed to terminal 66*a*. Thus, closure of switch 88 to terminal 88*a* energizes fill valve solenoid 48 through switch 66 and switch 88. During normal operation when the liquid level rises to the predetermined full level, switch 66 is moved by float means 56 to its full position closed to terminal 66*b*, thereby de-energizing solenoid 48 which closes the fill valve, terminating fill when the liquid level rises to the full level slightly above the prime levle. In the event float switch 66 is not closed to terminal 66*b* after a predetermined period either due to a float malfunction, insufficient water pressure or some other problem, fill is terminated by switch 88, which is switched by timer motor 80 from terminal 88*a* to terminal 88*c* thereby de-energizing solenoid 48. After the washing liquid is circulated in the wash chamber for a predetermined period, the pre-wash cycle ends with a drain cycle, initiated when timer motor 80 actuates switch 90 to energize drain solenoid 94. The drain means includes a drain pump driven by pump motor 32. Drain pump 32 is connected to a drain conduit (not shown) via solenoid actuated drain valve means (not shown) of the type which once opened is held open by the pressure of the liquid being drained, and thus remains open until the liquid is fully pumped out. The drain conduit is connected to the household plumbing for removing liquid from the wash chamber. When energized, drain solenoid 94 opens the drain valve means. Once opened by energization of drain solenoid 94, the liquid passing through the outlet into the drain conduit maintains the drain valve open until the liquid is essentially fully removed from the wash chamber. Thus, as shown in FIG. 7, solenoid 94 is not energized throughout the drain period but rather only energized long enough to initiate the draining of water by opening the drain valve means. Timer motor 80 after allowing a predetermined time period sufficient to allow full drainage of the wash chamber marks the end of the drain cycle by actuating switch 86. This initiates a check of the float switch 66 to determine whether the float switch has properly switched to its reset position. The check is continued by timer motor 80 which then deactuates switch 84 while switch 86 remains actuated. If float switch 66 is closed to 66*a* indicating reset of the float, continued energization of timer motor 80 is enabled by switches 66 and 86 notwithstanding the opening of switch 84 since switch 84 is shunted by actuated switch 86 and float switch 66 in its reset position. After a brief period, timer motor 80 actuates switch 84 and shortly thereafter deactuates switch 86. Following deactuation of switch 86, timer motor 80 then proceeds to initiate the next operating cycle which is typically a fill cycle. However, if for any reason float switch 66 remains closed to terminal 66*b* at the end of a drain cycle, continued energization of timer motor 80 will be prevented by the deactuation of switch 84. Once interrupted timer motor 80 will remain de-energized until corrective action is taken by the user or a service person. In this way, energization of the heater in subsequent cycles without sufficient liquid in the wash chamber is prevented.

The timing chart of FIG. 7 illustrates only the prewash cycle comprising a first fill, circulate and drain and the first wash cycle comprising second fill and circulate cycles during which the washing liquid is heated. In a typical full washing operation there will be several such fill, circulate, and drain cycles for washing and rinsing the dishes.

It will be appreciated that the control circuit arrangement disclosed herein is merely illustrative and that the present invention may be advantageously employed in dishwashing appliances incorporating many other control circuit arrangements providing a variety of sequential operations, including by way of example, a dishwasher employing solid state controller, rather than an electromechanical timer for controlling cycle operation of the appliance.

The foregoing is a description of an illustrative embodiment of the invention and it is the inventor's intention in the claims which follow to cover all forms which fall within the spirit and scope of the invention as claimed.

What is claimed is:

1. A dishwashing appliance comprising:

a wash chamber;

fill means for supplying liquid to said wash chamber;

a sump centrally positioned in the bottom of said wash chamber, defining the lowermost portion thereof, for accumulating liquid supplied to said wash chamber;

pump means including a housing centrally positioned within said sump for circulating liquid accumulated in said sump throughout said wash chamber;

said pump means further including impeller means rotatably mounted within said pump housing for rotation in a substantially horizontal plane; said impeller means having a bottom edge defining a dynamic prime liquid level; said impeller means being operative to prevent the liquid level in said sump from exceeding said prime liquid level until said pump means is fully primed;

float means mounted in said sump in close proximity to said pump housing for movement to a full position only when the liquid level in said sump exceeds the prime liquid level by a predetermined amount; and fill control means responsive to the position of said float means and operative to prevent said fill means from supplying liquid to said wash chamber when said float means is in its full position;

whereby entry of liquid into the wash chamber is prevented when the liquid level in the wash chamber exceeds said prime liquid level by a predetermined amount.

2. A dishwashing appliance comprising:

a wash chamber;

fill means for supplying liquid to said wash chamber;

a sump centrally positioned in the bottom of said wash chamber defining the lowermost portion of said wash chamber, for accumulating said liquid in said wash chamber;

pump means including a housing centrally mounted within said sump for circulating liquid accumulated in said wash chamber;

said pump means further including impeller means rotatably mounted within said pump housing for rotation in a substantially horizontal plane, the bottom edge of said impeller means defining a dynamic prime liquid level; said impeller means being operative to prevent liquid level in said sump from exceeding the prime liquid level until said pump means is fully primed;

float means mounted in said sump in close proximity vertically and laterally to said impeller for movement to a full position only when the liquid level in the sump is at a predetermined full level above the dynamic prime level;

switch means mechanically constructed and arranged for actuation by said float means, having a reset position and a full position; said float means being operative in its full position to place said switch means in its full position;

electrically actuated fill control means mechanically coupled to said fill means and electrically coupled to said switch means, said fill control means being operable when actuated to admit liquid from said fill means into said wash chamber and when deactuated to prevent liquid from entering said wash chamber from said fill means; said switch means being operable to enable actuation of said fill means when said switch means is in its reset position and to deactuate said fill means when in its full position, whereby fill is terminated when the level of liquid in said wash chamber is slightly greater than the prime level.

3. A dishwashing appliance in accordance with claim 1 or 2 further comprising:

baffle means positioned in the sump and partially enclosing the area around said float means, said baffle means being constructed and arranged to permit liquid to flow into and out of that area while sheltering that area from turbulent liquid flow caused by the rotation of said impeller means.

4. A dishwashing appliance in accordance with claim 3 further comprising:

cover means extending over said float means to protect said float means from liquid being circulated in said wash chamber.

5. A dishwashing appliance in accordance with claim 4 wherein said baffle means is formed integrally with and extends downwardly from said cover means.

6. A dishwashing appliance in accordance with claim 5 wherein said sump further comprises a vertical stand pipe formed integrally therewith, said stand pipe defining an opening therethrough and wherein said float means comprises:

a float partitioned into a plurality of chambers, each having an open bottom, and an inverted U-shaped stem portion including a first leg projecting upwardly from said float adjacent to said stand pipe and parallel to the opening therein and a second leg being slidably received and vertically extending within the opening of said stand pipe with the free end of said second leg projecting from said stand pipe externally of said sump.

7. A dishwashing appliance in accordance with claim 6 wherein said switch means comprises a switch housing; a snap action switch mechanism enclosed within said housing; and a leaf actuator mounted at one end of said housing; and wherein said switch housing is mounted externally to said sump adjacent said stand pipe opening; the free end said leaf actuator extending beneath said opening for actuating engagement by the free end of said second leg of said float stem when said float is in its second position.

* * * * *